US005913642A

United States Patent [19]

Boehler et al.

[11] Patent Number: 5,913,642

[45] Date of Patent: Jun. 22, 1999

[54] FEED CHUTE FOR FIBER TUFTS

[75] Inventors: Rolf Boehler, Schaffhausen; Lucas Hiltbrunner, Wiesendanger, both of Switzerland

[73] Assignee: Maschinenfabrik Rieter AG, Winterthur, Switzerland

[21] Appl. No.: 08/967,277

[22] Filed: Nov. 7, 1997

Related U.S. Application Data

[63] Continuation of application No. 08/611,091, Mar. 5, 1996, abandoned.

[30] Foreign Application Priority Data

Mar. 8, 1995 [CH] Switzerland ..... 0664/964

[51] Int. Cl.[6] ..... B65G 53/66

[52] U.S. Cl. ..... 406/171; 406/70; 137/513.5; 137/527.8

[58] Field of Search ..... 406/70, 171, 172, 406/175; 137/513.5, 527, 527.8; 19/97.5, 105

[56] References Cited

U.S. PATENT DOCUMENTS 4,878,784 11/1989 Binder et al. ..... 406/171 X

FOREIGN PATENT DOCUMENTS 563700 10/1993 European Pat. Off. ..... 406/171
2333694 1/1975 Germany ..... 137/527

*Primary Examiner*—Andrew C. Pike
*Attorney, Agent, or Firm*—McAulay Nissen Goldberg Kiel & Hand, LLP

[57] ABSTRACT

A flap is disposed across the opening between an expansion chamber and an exhaust air duct to control the delivery of fiber tuft-laden air into a feed chute or chamber. The flap has two wings which pivot about a common pivot axis whereby as one wing increases the flow cross section from the expansion chamber, the other wing reduces the flow cross section. A pressure difference produces forces on both wings simultaneously.

16 Claims, 6 Drawing Sheets

Figure 4:
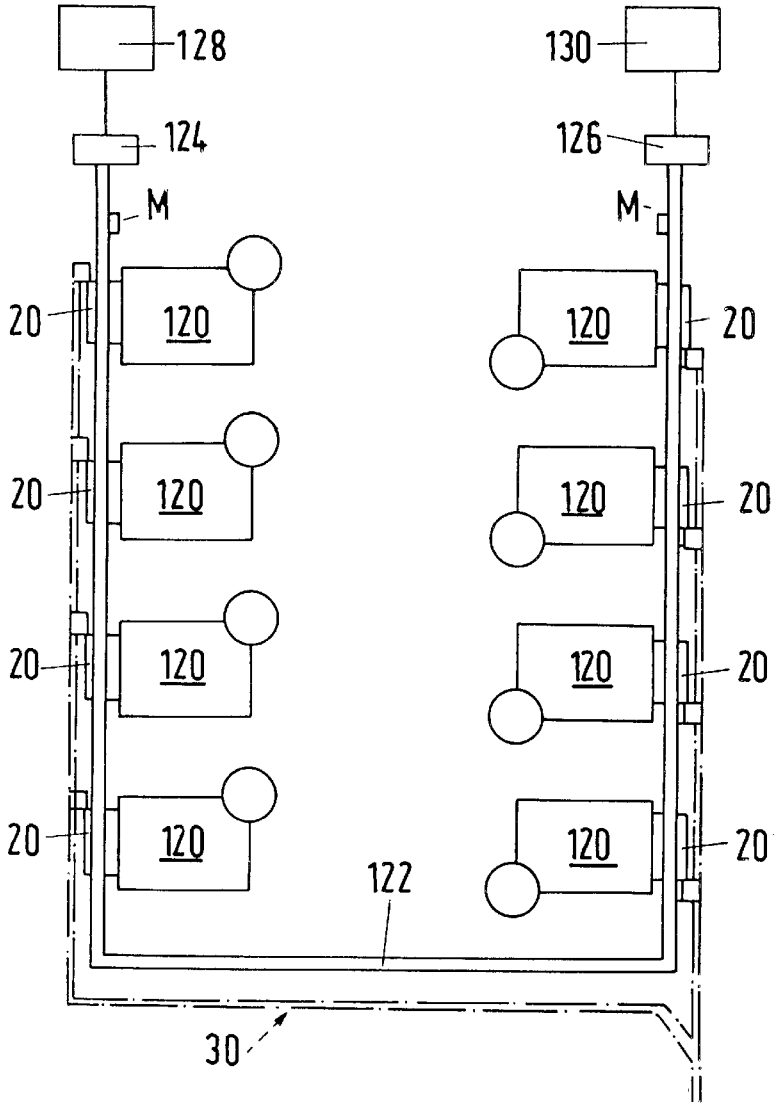
Fig.4 PRIOR ART

Fig.1 PRIOR ART
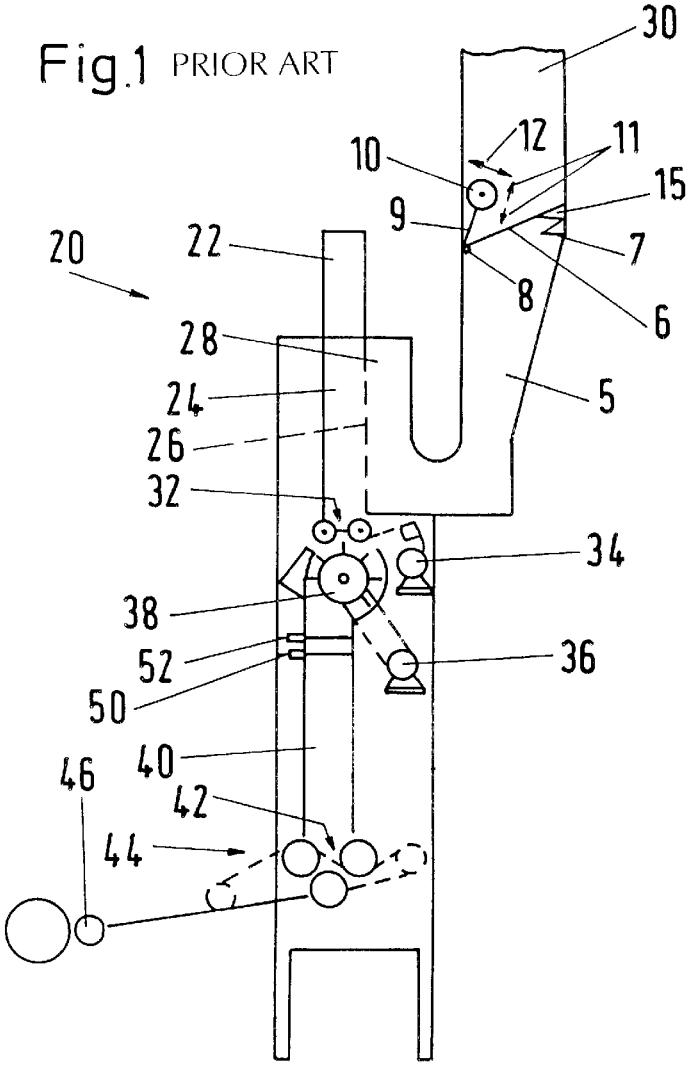
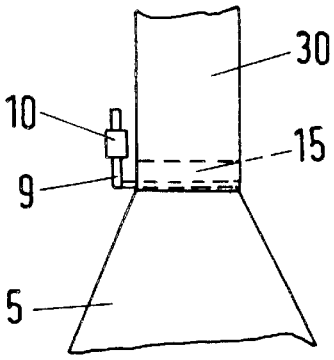
Fig.2 PRIOR ART
Fig.3 PRIOR ART
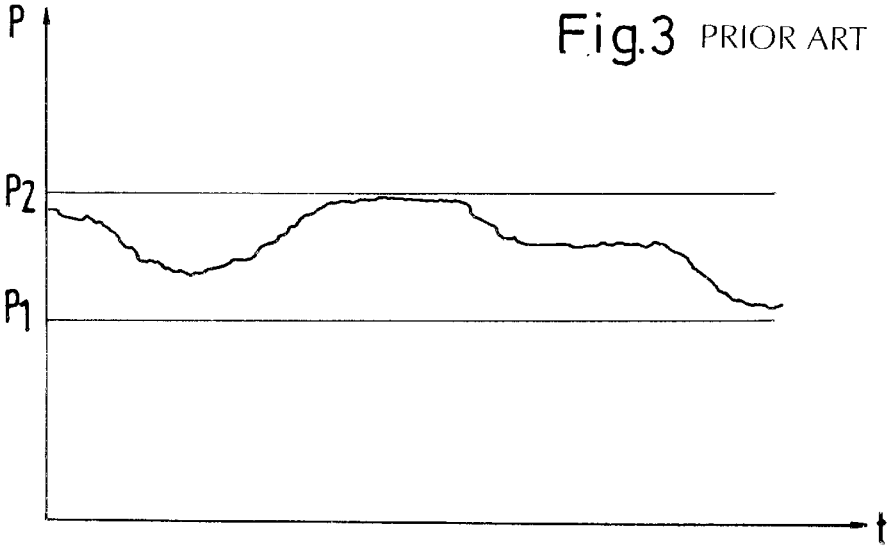

Fig.6 PRIOR ART
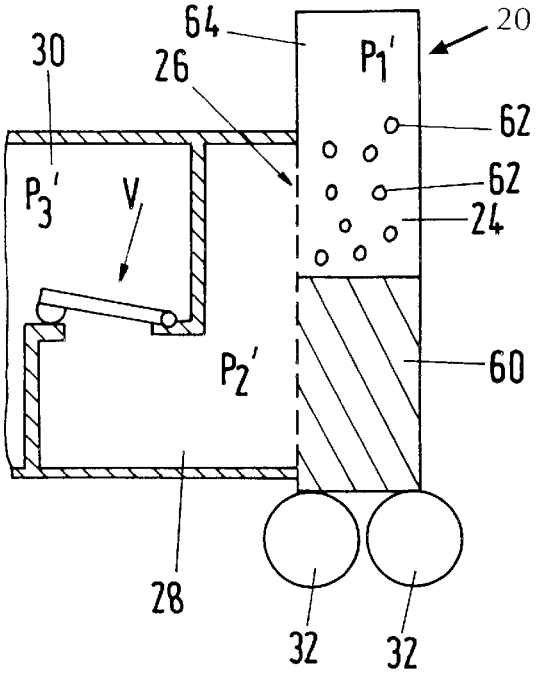
Fig.13
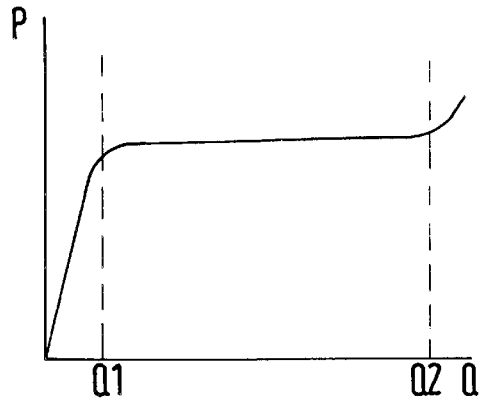
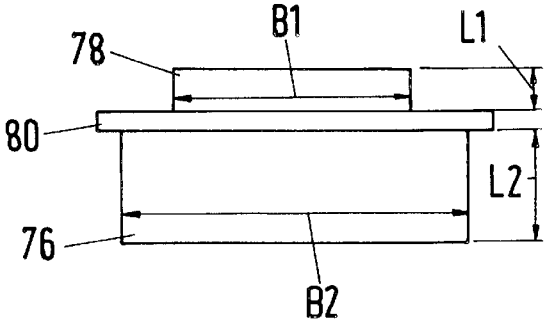
Fig.10
Fig.7 PRIOR ART
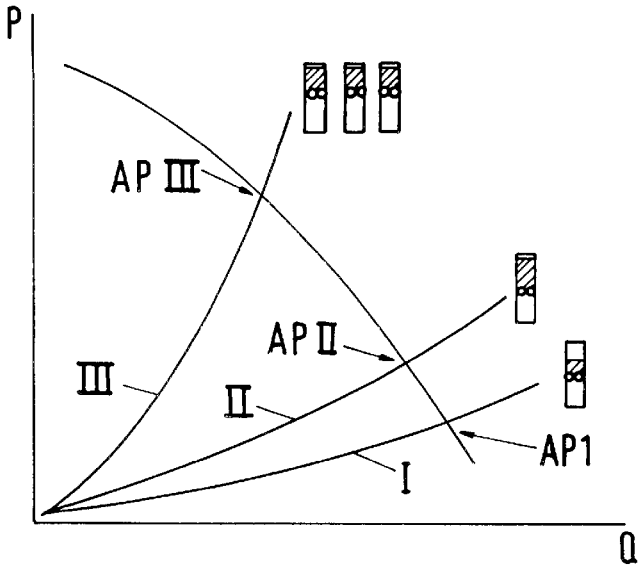

FEED CHUTE FOR FIBER TUFTS

This is a continuation of application Ser. No. 08/611,091, filed on Mar. 5, 1996, now abandoned.

The invention relates to a feed chute (for instance at a card) or a similar feed chamber (for instance in a blender (mixer), for instance according to European Patent Application 383246) which during operation is supplied with fiber tufts from a pneumatic tuft conveying system. The chute or feed chamber, as the case may be, separates the tufts from a conveying air stream, which air stream is then exhausted through an air duct. The pressure conditions in the chute, or feed chamber, change as a function of the filling level and this fact is preferably utilized to influence the supply of the tufts from the conveying system to the chute or feed chamber. Known art A feed chute for a card which operates according to the previously described method is known from U.S. Pat. No. 4,878,784. A blender (mixer) which is provided with a similar chute is disclosed in European Patent Application 383246 and a suitable feed chamber is disclosed in European Patent Application 563700. The function for discharging a pneumatic tuft conveying flow from the feed duct into a feed chamber of that type depends on the momentary effective relation between the pressure in the feed chamber and the pressure in the tuft conveying duct at the entrance of the chute. According to U.S. Pat. No. 4,878,784 as well as according to European Patent Application 563700 these relations depend on the momentary filling level in the feed chamber.

In both cases, there is also a valve mounted between the feed chamber and the exhaust air duct. The valve according to U.S. Pat. No. 4,878,784 is closed through positive action, if there is no need for material from the feed chute. Thus, the discharge of conveying air from the feed duct into the chute is stopped. Otherwise, the valve is open due to the pressure difference between the intake and discharge and the valve itself influences this difference in dependence of the selected arrangement (according to FIG. 5, FIG. 6 respectively of U.S. Pat. No. 4,878,784 patent). The influence of the valve can be chosen through the adjustment of a force exerting means consisting of a lever and a shiftable weight, within given limits.

The valve according to European Patent Application 563700 is not closed through positive action and as long as a pressure difference is maintained between both sides of the valve, at least a "remnant flow" passes through the valve. If this remnant flow develops sufficient force, the valve opens itself; if the remnant flow drops below a predetermined force, the valve closes itself again. In this case too the functional behavior of a valve can be influenced by way of an adjusting means, which comprises a lever with a shiftable weight attached to the lever.

These systems generally perfom excellently and have proven to be useful in practice during the past years. However, the ability of these systems to adjust themselves to the pressure changes proved to be insufficient in practice and are repeatedly the subject of complaints. The reasons for them are explained closely hereafter in connection with the figures of the drawings, so that at this point no further details need to be disclosed. From the above mentioned facts it becomes clear, however, that an object of the invention is to provide a valve for the above mentioned purpose, which at least, over a sufficient range is self-adjusting in relation to pressure changes.

The invention

The invention comprises a feed chamber for fiber material, which during operation is supplied with fiber tufts from a pneumatic tuft conveying system, which separates the tufts from the conveying air stream and which exhausts the air through a valve. The pressure conditions in the feed chamber change as a function of the filling level and are utilized to influence the delivery of the tuft-laden air to the feed chamber from the conveying system. The valve comprises a flap, which, by its weight, remains in a predetermined resting position if no air flows through the valve. Also, while in the resting position, at least one opening remains which allows a flow through the valve. This flow produces forces on the flap, so that, at given flow conditions, the flap is forced out of its resting position, thereby changing the flow section of said opening.

The opening can be one of two openings of a kind, which can be influenced by the position of the flap in such a way, that at least within the given range of movement, an enlargement of the flow section of one opening is accompanied by the reduction of the flow section of the other opening.

Adjustment means (such as lever and shifting weights) are not necessary.

The flap can be movably supported on a holder, so that the position of the flap, in relation to the holder depends on the difference of pressure between one side and the other side of the flap. The flap can be supported rotatably and can comprise two wings, whereby an air stream passing the flap will have to produce forces at least on one of the two wings.

One of the wings can be arranged in such a way that it influences the flow section of a first flow opening. The other wing can be arranged in such a way that it influences the flow section of a second flow opening. The arrangement can be furnished in such a way that the second flow opening is closed if the first flow opening is opened to its maximum flow section and/or the first flow opening is closed if the second flow opening is opened to its maximum flow section. In this context the "flow section" represents the determining factor for the flow resistance of the opening.

The wings can be of flat shape. They preferably extend slantedly from the holder away in the direction of flow.

Figure 5:
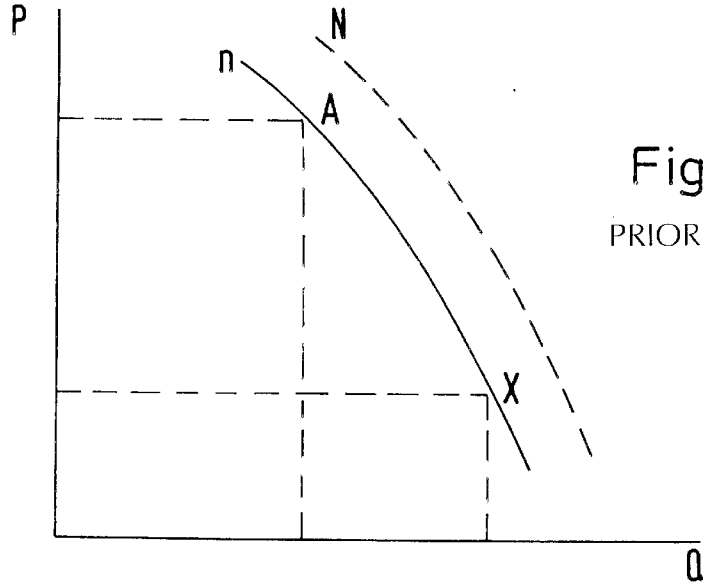
Fig.5 PRIOR ART
Figure 8:
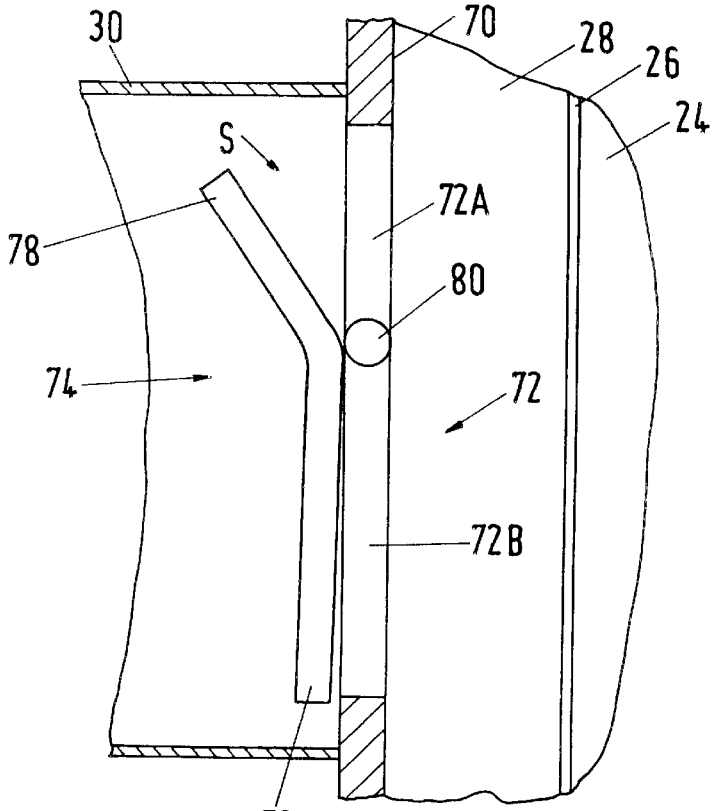
Figure 9:
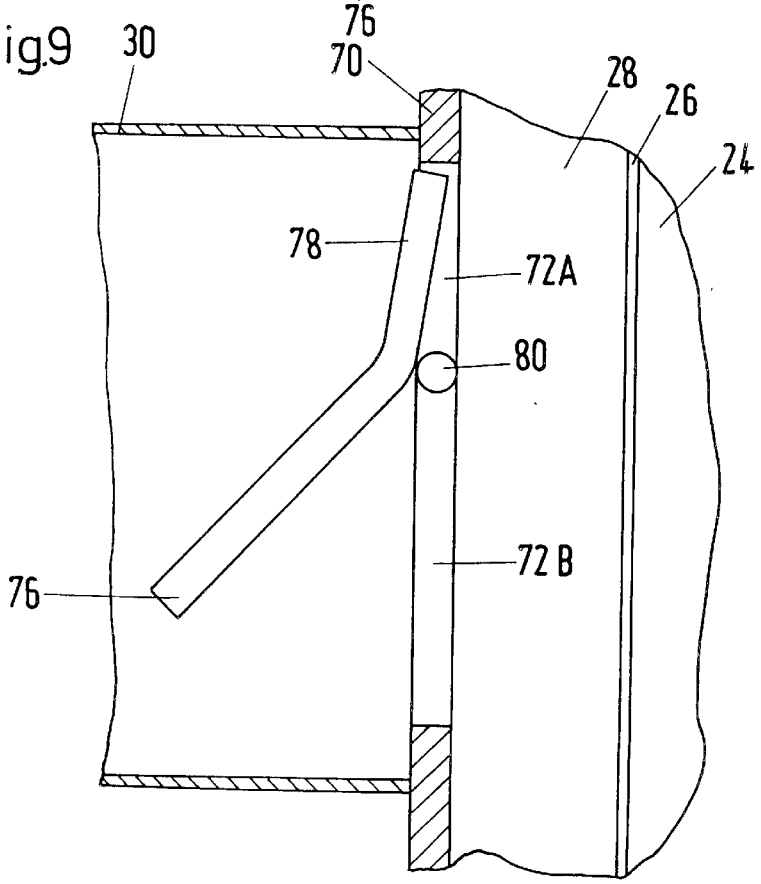
Figure 11:
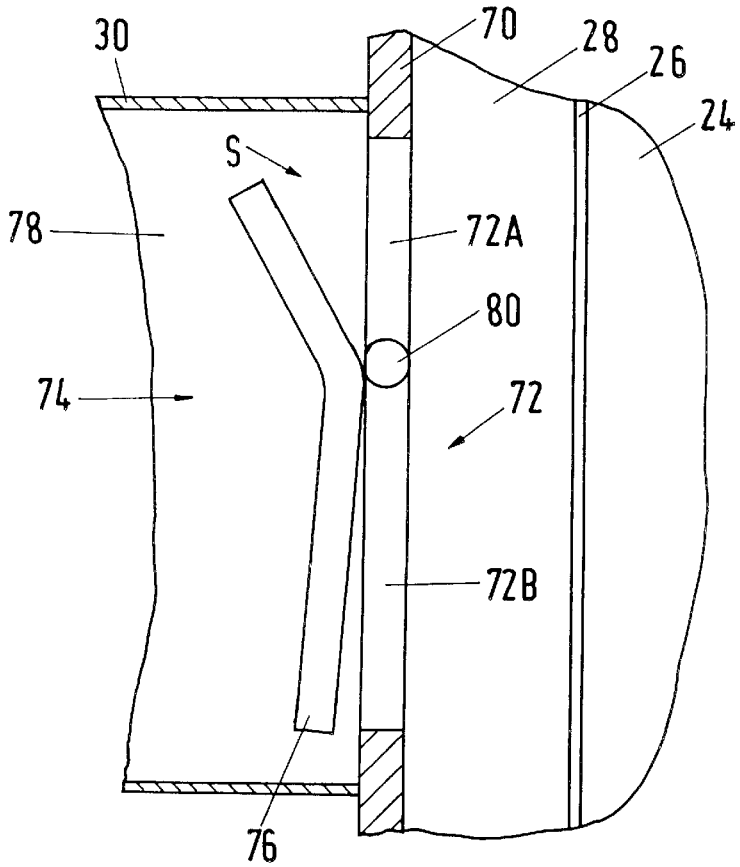
Figure 12:
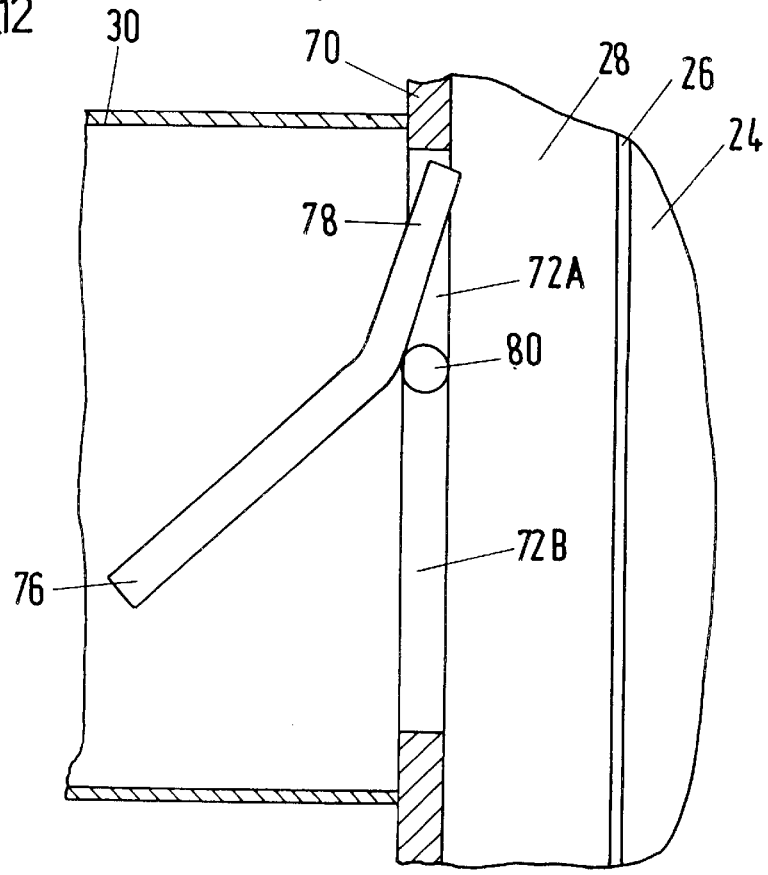
Figure 14:
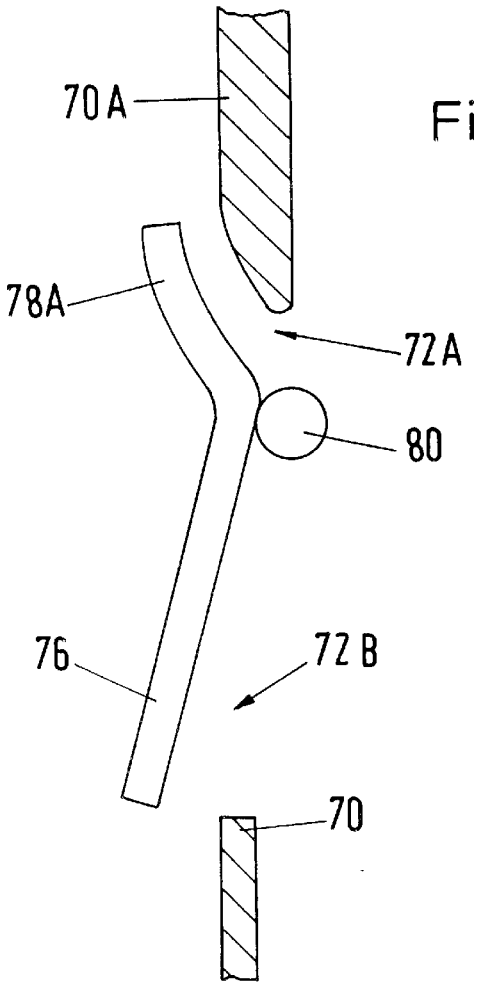

Embodiments of the invention are described in the following according to the figures of the drawings, wherein shows:

FIG. 1, a copy of figure 1 from European Patent Application 286950, supplemented by an exhaust air duct according to European Patent Application 563700;

FIG. 2, a copy of the figure 1A from European Patent Application 563700;

FIG. 3, a diagram to explain the desired behavior of an exhaust air flap according to FIG. 1;

FIG. 4, a copy of the Fig. 1from European Patent Application 303023;

FIG. 5, a copy of Fig. 2 from European Patent Application 303023 for the purpose of explaining the configuration in the installation;

FIG. 6, a schematic view of the transition part from the feeding duct into the feed chute for the purpose to explain problems, which occur during practice within the chute according to FIG. 1;

FIG. 7, a diagram to further explain the functional behavior of a installation according to FIG. 4;

FIG. 8, a side view in cross section of a first embodiment of an exhaust air flap according to this invention with the flap in a first position;

FIG. 9, a similar view of the same flap in a second position;

FIG. 10, a view of the flap of FIG. 8 as viewed in the direction of the flow;

FIGS. 11 and 12, views of the same flap corresponding with FIGS. 8 and 9, but after self-adjustment of the flap in response to a change in condition of the system;

FIG. 13, a diagram to explain the behavior of the new valve at pressure changes in the feeding chute;

FIG. 14, a side view similar to FIG. 8 of a modified design; and

Figure 15:
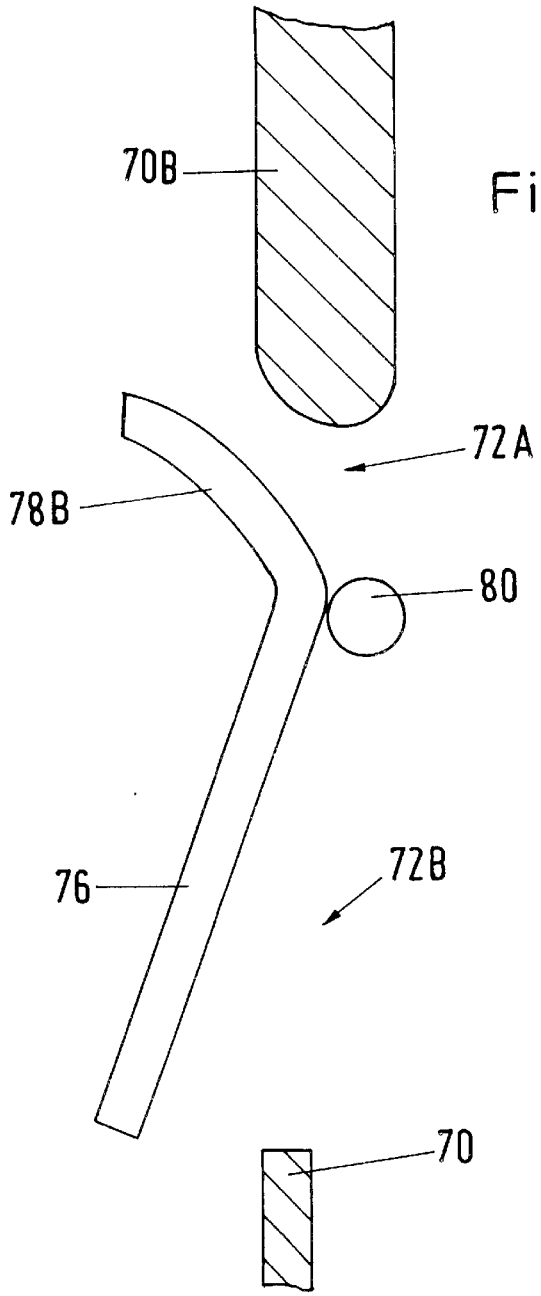

FIG. 15, a side view similar to FIG. 8 of a further modified design.

FIGS. 1 and 2 show the known state of the art. During operation, the feed chute 20 according to FIG. 1 is fed with fiber tufts from preceding machines of a blow room line via a pneumatic feed duct 22 (also called conveying duct). From this duct 22, tufts are fed into the feed chute 20, in that part of the conveying air stream is led downwards into a feed chamber 24. A wall 26 of this chamber 24 is perforated for air passage, so that the conveying air can enter an expansion chamber 28 and from where the air can discharge into an exhaust air duct 30. The tufts themselves cannot pass through the perforations of the wall 26 and form a (not shown) cotton batt in the feed chamber 24 above a feed roller pair 32.

The feed rollers 32 can be driven by a motor 34 to feed material taken off from the batt, from the chamber 24, to an opening roller 38 driven by means of a motor 36. Accordingly, the chamber 24 thus serves as a feed chute storing a certain amount of material.

The material conveyed by the feed rollers 32 and the opening rollers 38 either drops as small tufts or as single fibers into a so called feeding silo 40, where it builds up a column of fibers or tufts (not shown) above a pair of delivery rollers 42. By a drawing off unit 44, the material from the lower end of this column can be supplied to a feed roller 46 of a not further shown card. Although the feed chute 20 is designed in particular for the feeding of the card, it is principally possible to use a similar chute for feeding the fiber material to other machines of a blowing room machine line. The supply from the drawing-off unit 44 depends on the demand of the machines that follow, which demand can periodically vary to a great extent. Despite this, it is important to maintain a constant height and compression of the material column as far as possible.

A device for sensing the height of the column in the feed silo 40 is provided and comprises in the shown example a lower light barrier 50 and an upper light barrier 52. The function of these light barriers in connection with the motor 34 is well known and has been described in the literature; thus a further description is not necessary in this disclosure.

The expansion chamber 28 comprises an arc shaped duct part followed by a funnel shaped part 5, provided with a throttle wing 6 (or flap) at its end which is followed by the exhaust air duct 30. The throttle wing 6 is swivably supported on a rotatable axis 8, the axis 8 being held stationary.

At the end of the throttle wing 6 opposite to the axis, the throttle wing is furnished with a bulge 15, which, as indicated in FIGS. 1 and 2, in its resting position rests against a stop 7. The bulge 15 is provided with a groove (not shown), which leaves an opening between the bulge 15 and the stop 7 when the bulge 15 is resting on the stop 7, through which groove a tolerable, substantially predetermined quantity of air can flow. It is also possible to provide a bulge similar to the bulge 15 on the stop 7 furnished with an opening in between similar to the above mentioned groove for the passage of a quantity of air.

In addition, the rotatable axis 8 is provided with a weight lever 9 outside of the air duct consisting of the funnel shaped part 5 and the exhaust air duct 30. With regard to its swinging position, the lever 9 can be adjusted according to the arrows 12 indicating the swinging direction and it can be fixed in a given position. On the weight lever 9, furthermore, a shiftable weight 10 is provided, which can be shifted in the directions 11, indicated by the arrow, on the weight arm 9 and fixed in a predetermined position.

The weight of the throttle wing 6 and the weight of the weight lever 9 as well as the shiftable weight 10, in combination with the position of said shiftable weight 10 on the weight lever 9, is chosen in such a way in that, when the throttle wing 6 is open, a nearly unstable balance is provided between the throttle wing 6 and the weight lever 9 together with the shiftable weight 10.

Only little excess of pressure head is required to keep the throttle wing 6 open. In spite of this the wing closes as soon as the air flow drops below a predetermined lower limit.

FIG. 3 shows a change of the pressure P (ordinate) in the feed chamber 24 with the time (abscissa), whereby it is assumed, that for the exhaust air wing according to FIG. 1, an upper limit pressure head value P2 and a lower limit pressure head value P1 have been defined. At the lower limit pressure head value P1 in the feed chamber 24, the wing should rest on the stop and at the upper limit pressure head value P2 in the feed chamber 24, the wing should be completely opened. The upper limit pressure head value P2 should correspond with the filling level with the state "feed chamber full", so that at that pressure level in the feed chamber no further fiber tufts (or only very few respectively) are to be delivered from the conveying system into the feed chute. The lower limit pressure head value P1 should correspond with the filling level state "minimal", so that at this pressure head fiber tufts are delivered at the maximum possible feeding rate.

It is understood, however, that these pressure levels not only depend on the filling level of the feed chamber, but also on the pressure level in the feeding chute (at the chute entrance). This level represents a "reference value" which influences the pressure head in the feed chamber during the state "feed chamber full" as well as during the minimally allowed filling level. For relevant changes in pressure at the chute entrance, the position of the weight 9 along the lever 10 can be shifted, whereby for instance an upwards shifting of the two values P2, P1 respectively results, in order to accomplish a corresponding shifting of the reference value. This adjusting device has to be used at least during assembly and when starting operation, in order to set the complete installation. The procedure, however, is difficult and the device does not suffice for practical application when a new setting up is to be carried out during normal operation, as will be explained further hereafter according to the FIGS. 4 to 6.

The example according to FIG. 4 shows an installation that comprises a so called "line" of altogether eight cards 120. Above these cards runs a common feed duct 122. In the example, the cards are arranged in two rows, and thus the feed chute is U-shaped, which arrangement, however, is not relevant for this invention. At each end of the conveying duct 122 a fan 124, 126, respectively, is connected that supplies conveying air. Each fan 124, 126, respectively, has a feeding machine 128, 130, respectively, arranged to it to deliver fiber tufts.

Each card 120 is provided with a respective feed chute 20, which receives tufts from the duct 122 and which delivers these tufts in the form of cotton to the corresponding card 120. The card arrangement shown in FIG. 4 can be separated into two so called "lines", thereby using a suitable separating means. Such separating means are disclosed in European patent application No. 175056. After respective adjustment of the separating means, the installation can be put into operation in that one card line is delivered with tufts from the feed machine 128 and the other card line is delivered with fibers from the feed machine 130, whereby the number of cards per line can be suited to the production conditions of the spinning mill.

Each line gives a certain flow resistance for the respective fan 124, 126 respectively, which is expressed as a definable static pressure on a measuring device M in the duct 122 between the fan 124, 126 respectively and the first card of the line. If now the separating means is to be newly adjusted, then each newly defined line will give different flow resistance values for the respective fan 124, 126 respectively (higher or lower), which is expressed by a correspondingly change of static pressure on the measuring device M.

FIG. 5 schematically shows the characteristic curve of a fan 124 or 126. For a predetermined operating speed n of the fan 124, 126 respectively, the static pressure P at the discharge side of the fan is connected (in connection) with the characteristic curve of the fan with the conveyed quantity of air Q. At a higher flow resistance of the installation (higher static pressure at the measuring device M) the fan conveys a relatively low quantity of air, for instance according to operating point A. At unchanged speed n, but a considerably reduced resistance (static pressure) the fan will convey a considerably higher quantity of air, for instance according to operating point X.

This functional behavior of the fan can be adjusted to the conditions in the line, since a larger number of cards in the line results in a reduced flow resistance (static pressure) but, at the same time, requires an increased quantity of air. Therefore, it is not necessarily compulsory to carry out the required adjustment of the air quantity by a corresponding shifting of the characteristic curve of the fan (for instance for an increase of the air quantity, by a corresponding increase of the speeds of the fan from n to N, as indicated in FIG. 5 with a dotted line). The "definition" of the line connected (in connection) with the fan (that is of the "configuration the installation") determines without further action the static pressure at the exit of the fan and thus the quantity of air conveyed by the fan.

An installation according to FIGS. 4 and 5 has a further advantage namely it can also adjust itself to the momentary operating conditions in the line, under the condition that a distinctive change of the operating conditions (for instance the breakdown of a card) leads to a corresponding change of the flow resistance (static pressure) within the system. This is the case within a system with feed chutes according to FIG. 1, since the breakdown of a card causes a throttling of the discharge of the conveying air from the feed duct 22 into the exhaust air system 30 and thus increases the flow resistance (static pressure) within the feeding system. This behavior can be utilized according to European Patent Application 303023 in order to allow control of the tuft feed.

The fan is thus self-adjusting, but the chutes connected to it are not. This poses a considerable problem in practice, as will be explained hereafter according to FIG. 6.

FIG. 6 schematically shows the conditions in the upper part of a feed chute 20. The shaded area 60 indicates a buildup of a column of tufts, which fills the feed chamber 24 about half way, whereby at this filling level tufts 62 should be continuously supplied from the feed duct. The uppermost space 64 of the feed chamber 24 assumes a static pressure of P1', which is mainly determined by the pressure in the feed duct. At the downstream side of the schematically indicated valve V, the exhaust duct 30 assumes a static pressure P3', which is mainly determined by the capacity of the exhaust system. The expansion chamber 28 assumes a static pressure of P2'.

If the valve V is fully closed (which for instance in a system of the previously mentioned U.S. Pat. No. 4,878,784 can be forced by means of a control device), the pressure P2' increases to a value which approaches the value of pressure P1'. Thus, the delivery of tufts into the feed chamber 24 is effectively stopped since a discharge of a conveying air flow from the feed chamber 24 does practically not take place anymore.

If now with an open valve V, the column of tufts in the feed chamber 24 increases to the upper rim of the wall 26, a considerable drop of pressure develops between the space 64 and the chamber 28, so that P2' lies distinctly below P1'. This condition prevails while the valve V is being closed (the wing 6) in a system according to FIG. 1, whereby in this case the previously mentioned minimum quantity of air can still flow through the groove in the bulge 15. The pressure drop P1'−P2' is, however, determined by the design of the feed chamber 24. The pressure P2' at the state "feed chamber full" thus depends on the momentary value of the pressure P1'.

As, however, has been explained with FIGS. 4 and 5, the value P1' basically changes in dependence of the chosen configuration of the installation. Furthermore there is also a certain influence from the momentary conditions of the other chutes that are fed by the same fan. This is illustrated in FIG. 7, wherein once again the characteristic curve of the fan is shown, this time however, with three characteristic curves I, II, III respectively, of the installation, in order to define three operating points AP1, APII, APIII respectively of the fan. Point AP1 corresponds with an installation condition, whereby all the chutes connected to this fan are empty. Point APII corresponds with a condition resembling an unchanged configuration of the installation, whereby all the chutes are full. Point APIII corresponds with a condition at which once again all the chutes are full, this time, however, with a changed configuration with additional feeding chutes arranged to the fan (this means a condition with an upward shifting of the "reference value").

In an installation with feed chutes according to FIG. 1 changes of configuration should be carried out with the manual readjustment of the weight 10 on lever 9 for each feed chute. This readjustment operation, however, turns out to be a rather delicate procedure, because the feed chutes react as "individuals" to a shifting of the weight, rather than according to a predetermined pattern. In practice therefore, readjustments are often neglected. Where these readjustments are carried out, the various feed chutes sometimes, in the end, turn out to show different basic settings.

According to the present invention each flap should autonomously assume its own basic position, which is in agreement with the prevailing "reference value" of the pressure in the feed chute. This aim is reached by an embodiment according to FIGS. 8 and 9. For elements that already correspond with these elements described in the arrangement according to FIG. 1, the same reference numbers are used in the FIGS. 8 and 9. These are—the feed chamber 24 of the feed chute, the perforated wall 26 for the air passage, the expansion chamber 28, and the exhaust air duct 30. A valve assembly separates the duct 30 from chamber 28 and is constructed of a wall or support frame 70 secured to a wall (not shown) provided with an opening 72, which allows the flow of air from the chamber 28 into the duct 30 as well as a flap 74 rotatable mounted in the frame 70 to influence the flow of air through the opening 72.

The flap 74 comprises one single piece of plate with two wings 76, 78 respectively, bent in relation to each other. The flap 74 is rotatably mounted on a horizontally rotatable axis 80 (e.g., defined by an axle) between the wings 76,78 such that the axis 80 divides the opening 72 into an upper part 72A and a lower part 72B.

As can be seen in the example according to FIG. 10, the rectangular wings 76, 78 are of different widths B1, B2 and the length L1 (in direction away from the axis 80) of the wing 78 is considerably shorter than the corresponding length L2 of the wing 76. The thickness of the material is the same for both wings so that the weight of the lower wing 76 is higher. The flap 74 is free-rotatably mounted to take on the illustrated position of FIG. 8, if no air flow prevails. The flap 74 is preferably made of a lightweight material with the dimensions of the wings suited according to the desired function of the flap (characteristic curve) as will be disclosed hereafter.

In the position of FIG. 8, the opening 72A presents its greatest possible flow section in relation to the wall 70. It is not necessary to choose the shown position as the basic setting of the flap, but it is assumed here for the sake of simplicity.

The position of the flap according to FIG. 8 is considered as the state "full" and the position according to FIG. 9 as the state "empty". These positions correspond with a full state and a empty state, respectively, of the chamber 24. At full state, the wing 76 rests on the wall 70, so that practically no flow is possible through the partial opening 72B. Between the wing 78 and the wall 70, however, a gap S remains open. This gap corresponds with the "minimum rate of flow opening" according to European Patent Application 563700. At the empty state, the upper wing 78 rests on or is close to the wall 70 so that the flow passage through the partial opening 72A is interrupted. The wing 76 however is now far away from the wall 70 so that the maximum flow through the partial opening 72B is possible.

From its position according to FIG. 8, the flap 74 swings to the position according to FIG. 9 through a turning movement in a clockwise direction (according to these figures). The corresponding moment of rotation is produced by the air flow at the flap and has to overcome the effect of the weight of the flap. If the air flow declines, the opening moment of rotation decreases accordingly, and the flap 74 falls back into the position according to FIG. 8. The flap 74 can adjust itself to a variation in the air flow conditions within the chamber 28, since the previously mentioned air flows cause forces on the wings 76,78 and because these wings can be shaped to such a form that the valve exhibits a predetermined behavior as a reaction to predetermined flow conditions.

For further explanation, it is assumed that the pressure P3' in the duct 30 near the flap always remains constant. This assumption simplifies the description, but is of no significance for the mode of operation in practice. It is also first assumed that the configuration of the installation remains unchanged. This assumption is then abandoned in the following when the changed positions according to FIGS. 11 and 12 are to be explained.

At "full" state (FIG. 8) the pressure P2' exerts a force on the lower wing 76 in chamber 28, which generates a moment of rotation (torque) in clockwise direction (that means in the opening direction). The air also exerts a force onto the wing 78, which according to the Bernoulli equation depends upon the pressure P2' as well as from the quantity of air which flows through the opening 72A. The force acting on wing 78 also produces a moment of rotation (torque) on the flap 74, which is further explained in the following description in connection with the FIGS. 14 and 15. The weight of the flap 74 produces forces, which push the flap into the resting position according to FIG. 8 in order to close the main flow opening 72B. At full state (FIG. 8) the closing forces are still sufficient to overcome the resultant of the torques generated by the wings 76, 78. Despite this, the quantity of air which flows through the opening 72A is relatively small, because the chamber 24 is full (or rather should be full) and separates the expansion chamber 28 from the air supply in the feed duct.

If the height of the column in chamber 24 decreases, the pressure P2' in chamber 28 increases. The quantity of air entering the chamber 28 at the same time increases. The size of the surface of the wing 76 exposed to the pressure P2' can be chosen in such a way that during rising pressure P2' the moment of rotation in the clockwise direction increases rapidly. Accordingly, the flap 74 has to turn in the clockwise direction and thus an air flow begins to pass through the opening 72B, which further "opens" the flap, at the same time throttling the flow through the opening 72A. At the empty state (FIG. 9), a relatively high pressure P2' acts on the surface of the wing 78 and produces closing forces. The chamber 24, however, is practically empty and offers only a low resistance to the air flow from the feed duct. Therefore, a large quantity of air flows through the opening 72B and the corresponding forces on the wing 76 are sufficient to overcome all the closing forces.

The momentary position of the flap 74 clearly depends on the changes in the air conditions which develop due to the variation of the filling level. Such changes result in a reduction (increase) of the pressure P2' as well as a reduction (increase) of the air quantity flowing into the chamber 28. This means that during filling level changes, the effects of the corresponding changes in pressure and quantity of air reinforce each other within the chamber 28.

The system is thus less dependent on small variations of the flow conditions within the feed duct, because the effects of changes in the conditions, according to FIG. 7, at least partially balance themselves for the valve of an individual chute. A reduction of the pressure P1' is accompanied by the increase of the conveyed air quantity. The valve according to FIGS. 8 and 9 reacts, however, to the pressure difference (P3'–P2') as well as to the flowing quantity of air, this in relation to the closing forces as well as in relation to the opening forces of the valve.

The position of the flap basically remains dependent upon the "pressure reference level" in the feed duct, so that when the installation configuration is changed, the flap at full state (for instance) takes on a position according to FIG. 11 and at empty state a position according to FIG. 12. This means that the "basic setting" of the flap has shifted, so that also at a full feed chamber the opening 72B is not fully closed, and the opening 72A at an empty chamber does not anymore reach its maximum possible flow section. Accordingly, in spite of a full chamber, air flows pass both openings 72A and 72B. The arrangement can, however, be made in such a way that the total flow is still kept below a tolerable limit. Above this limit, the compression of the uppermost portion of the material column in the chamber 24 increases considerably and the quality of the delivered material is prejudiced. The suitable arrangement for the individual case has to be determined empirically. The following data, however, represent an example as guidelines:

width B1 of the wing 78: 400 mm
width B2 of the wing 76: 345 mm
length L1 of the wing 78: 30 mm
length L2 of the wing 76: 100 mm
possible pressure level within the feeding duct: from 0 to 2000 Pascal quantity of air conveyed:

duct: 0.4 to 1.2 $m^3/s$ chute: 0.05 to 0.8 $m^3/s$

In this example (in contrast to the example according to FIG. 10) the width B1 is chosen somewhat larger than the width B2.

The invention is not limited to the illustrated example. Rectangular wings 76,78 are not essential. The axis 80 can be supported by two bolts that protrude into the opening 72 from both sides. One wing can be arc-shaped in the direction away from the axis. The flap can be made from plate, for instance metal or plastic. The effectiveness of the force of gravity can be influenced through the choice of the thickness of the sheet.

Preferably, however, the mass of the wing is kept as low as possible.

The opening can be specifically formed in order to define a "frame" for the flap and thus to cause specific effects of the air flow. The flap can be biased so that it does not need to be erected in the shown position.

The valve according to the invention can also be delivered as a "retrofit set" for existing installations. This set of equipment can for instance include a support frame and a flap fitted within it, whereby the frame is provided with fastening means (for instance screw holes) to facilitate the mounting in existing installations.

By means of a valve according to the FIGS. 8 to 12 it is possible to obtain a valve characteristic which is similar to the one of FIG. 4 in the previously mentioned European Patent Application 563700, see FIG. 13. The behavior of the valve is characterized in that the flap 74 at low flow quantity Q fully opens itself and in that thereafter it assumes over a wide flow range Q1→Q2 a practically constant flow resistance (pressure difference Pa=P2'−P3'). The range Q1–Q2 corresponds with the normal operating range of the valve. At a further increase of the flow quantity Q, the valve causes a further increasing pressure difference—this however lies outside the previously mentioned normal operating range.

It is possible, however, to adjust the behavior of the valve to the required specifications, for instance through a different shape of the wings 76,78. The embodiment according to FIG. 8 to 12 comprises flat-shaped wings. FIGS. 14 and 15 each shows an alternative design of the wing 78. In both cases the wing 78A, 78B respectively, has an arc shape—in one case (FIG. 14) the wing 78A is shaped concavely, in the other case (FIG. 15) it is shaped convexly, each seen in the direction of the flow.

The wall 70 can be furnished with a counterpiece 70A, 70B respectively, to correspond with the specifically designed wing 78A, 78B respectively. With the design of the wing 78 it is possible to influence the sense of the direction of the moment of rotation, effected by this wing. Possible effects to be obtained are:

the kinetic energy of the air flow is at least partially changed into a static pressure, which forces the wing 78 into a counterclockwise direction (closing force), the flow effects a vacuum on the surface of the wing, limiting the opening 72A, whereby said vacuum effects a moment of rotation in clockwise direction (opening force).

The value of these forces depends on the form (curvature) of the wing as well as on its dimensions (L×B).

What is claimed is:

1. A valve assembly for mounting between a first air receiving chamber and a second air receiving chamber to control a flow of air therebetween, said valve assembly comprising a support frame for mounting between said chambers and defining an opening to communicate said chambers; and a flap rototably mounted in said frame on a pivot axis, said flap having a pair of oppositely directed wings, one of said wings being pivotable relative to said frame on said axis to open and close a flow section of a first portion of said opening in said frame and the other of said wings being pivotable relative to said frame on said axis to open and close a flow section of a second portion of said opening in said frame whereby an enlargement of said flow section of said first portion corresponds with a reduction of said flow section of said second portion of said opening.

2. A valve assembly as set forth in claim 1 wherein said wings extend from said pivot axis at an angle in a direction of said flow.

3. A valve assembly as set forth in claim 1 wherein said flap takes up a position under gravity with zero flow through said opening in said frame wherein each said wing is spaced from said frame whereby each said flow section of each said portion of said opening is open.

4. A valve assembly as set forth in claim 1 wherein said flap has a predetermined resting position with said one wing closing said first portion of said opening and with said other wing opening said flow section of said second portion of said opening.

5. In combination, a pneumatic fiber conveying system for conveying fiber tuft-laden air;

at least one feed chamber in communication with said fiber conveying system to receive a flow of the fiber tuft-laden air therefrom, said feed chamber having a perforated wall for exhausting air from said chamber while separating fiber tufts therein;

an expansion chamber adjacent said perforated wall for receiving the exhausted air;

an exhaust air duct communicating with said expansion chamber to receive and exhaust the air therefrom; and a flap between said expansion chamber and said exhaust air duct for autonomously controlling a flow of air from said expansion chamber to said exhaust air duct in dependence on a difference in air pressure between the air in said feed chamber and the air in said expansion chamber, said flap being disposed in a resting position over an opening with a portion of said opening being open to the flow of air from said expansion chamber into said exhaust air duct, said flap being displaceable from said resting position in response to an increase in said flow of air from said expansion chamber to said exhaust air duct.

6. The combination as set forth in claim 5 which further includes a support frame defining said opening and said flap is movably mounted on said frame.

7. The combination as set forth in claim 6 wherein said flap is rotatably mounted on said frame.

8. The combination as set forth in claim 7 wherein said flap has a pair of oppositely directed wings extending from a common axis of rotation, each said wing being disposed across said opening in said frame to produce a moment of rotation in response to said difference in air pressure between the air in said expansion chamber and the air in said exhaust duct.

9. The combination as set forth in claim 8 wherein one of said wings is disposed over said opening to influence a flow cross section of a first portion of said opening.

10. The combination as set forth in claim 9 wherein said other of said wings is disposed over said opening to influence a flow cross section of a second portion of said opening.

11. The combination as set forth in claim 10 wherein said other wing closes said second portion of said opening when said one wing completely opens said first portion of said opening.

12. In combination, a pneumatic conveying system for conveying tuft-laden air;

at least one feed chamber for receiving a flow of tuft-laden air from said system, for separating tufts from said flow and for exhausting air from said flow;

an expansion chamber for receiving the air exhausted from said feed chamber;

an exhaust duct for receiving air from said expansion chamber; and at least one rotatable flap disposed between said expansion chamber and said exhaust duct for autonomously controlling a flow section therebetween and wherein said flap assumes an operating position in response to the weight of said flap and forces generated by an exhaust air flow from said expansion chamber into said exhaust duct.

13. In combination, a pneumatic fiber conveying system for conveying fiber tuft-laden air;

at least one feed chamber in communication with said fiber conveying system to receive a flow of the fiber tuft-laden air therefrom, to exhaust air from said chamber and to separate fiber tufts therein, said feed chamber having pressure conditions therein which change as a function of a filling level of the separated fiber tufts therein and which influence a delivery of the fiber tuft-laden air to said feed chamber;

an expansion chamber adjacent said feed chamber for receiving the exhausted air;

an exhaust air duct communicating with said expansion chamber to receive and exhaust air therefrom; and a valve assembly between said expansion chamber and said exhaust air duct for autonomously controlling a flow of air from said expansion chamber to said exhaust air duct in dependence on a difference in air pressure between the air in said feed chamber and the air in said expansion chamber, said valve assembly having a flap disposed in a resting position over an opening at a zero flow of air from said expansion chamber to said exhaust air duct through said opening with a portion of said opening being open to permit the flow of air from said expansion chamber into said exhaust air duct, said flap being autonomously displaceable from said resting position in response to an increase in said air flow from said expansion chamber through said opening to said exhaust air duct.

14. The combination as set forth in claim 13 wherein said flap has a pair of oppositely disposed wings extending from a common pivot axis and aligned with said opening, one of said wings being disposed to close a flow section of a first portion of said opening and the other of said wings being disposed to simultaneously open a flow section of a second portion of said opening.

15. The combination as set forth in claim 14 wherein said wings are of different widths and different lengths relative to each other.

16. The combination as set forth in claim 15 wherein a lower one of said wings is heavier than a higher one of said wings.

* * * * *